United States Patent [19]

Sheiman et al.

[11] Patent Number: 4,831,860

[45] Date of Patent: May 23, 1989

[54] TOP-CHANGE COMBINATION LOCK

[75] Inventors: Samuel R. Sheiman, Brooklyn; Julius Sheiman, N. Woodmere, both of N.Y.

[73] Assignee: Crest Lock Co. Inc., Brooklyn, N.Y.

[21] Appl. No.: 197,981

[22] Filed: May 24, 1988

Related U.S. Application Data

[63] Continuation-in-part of Ser. No. 89,306, Aug. 25, 1987, abandoned, which is a continuation of Ser. No. 866,373, May 23, 1986, abandoned.

[51] Int. Cl.[4] ..... E05B 37/02

[52] U.S. Cl. ..... 70/312; 70/316

[58] Field of Search ..... 70/312, 316

[56] References Cited

U.S. PATENT DOCUMENTS

| | | | |
|---|---|---|---|
| 4,343,163 | 8/1982 | Scelba | 70/312 |
| 4,383,425 | 5/1983 | Orabona | 70/312 |
| 4,615,194 | 10/1986 | Büringer | 70/312 |
| 4,711,108 | 12/1987 | Garro | 70/312 |
| 4,722,208 | 2/1988 | Ye | 70/312 |

*Primary Examiner*—Henry E. Raduazo

*Attorney, Agent, or Firm*—Kirschstein, Ottinger, Israel & Schiffmiller

[57] ABSTRACT

A stop on a deadbolt of a top-change combination lock abuts against a hasp when the latter is in its latched position in order to prevent joint movement of an actuator and the deadbolt from being axially moved from a central position to a combination-changing position when the hasp is in its latched position.

2 Claims, 2 Drawing Sheets

FIG. 1
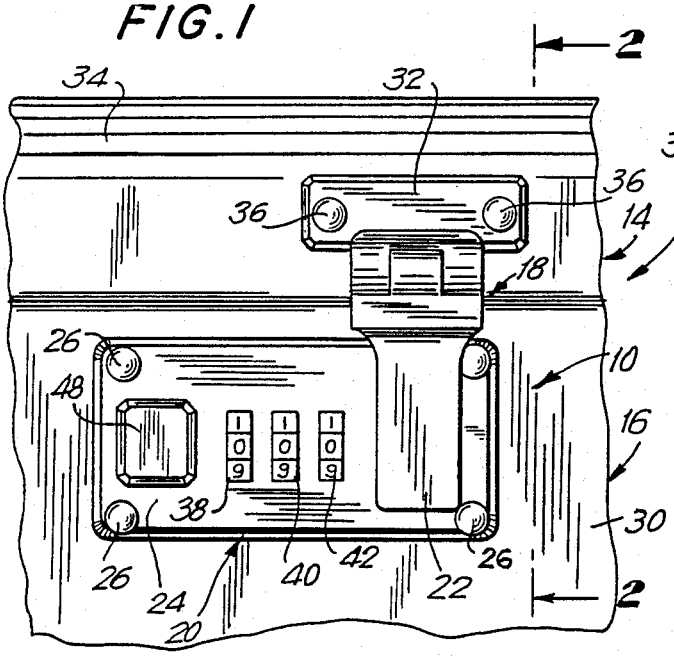
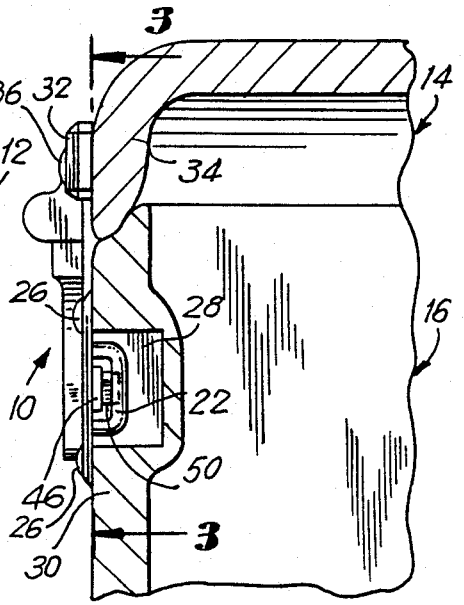
FIG. 2
FIG. 3
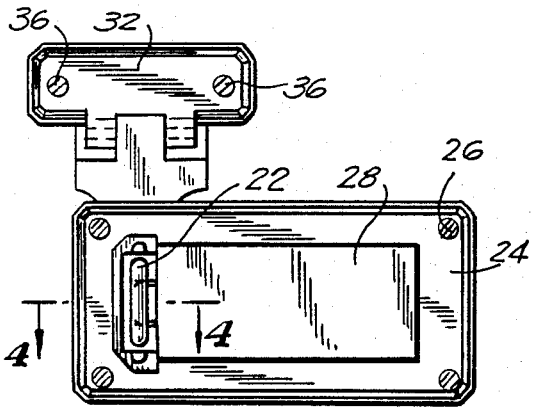
FIG. 4
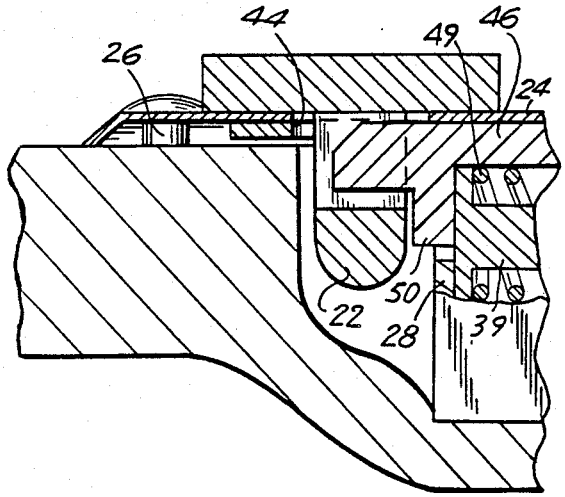
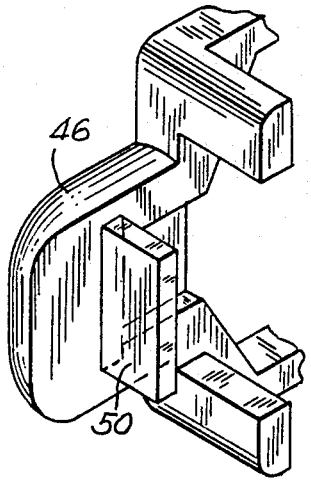
FIG. 5

TOP-CHANGE COMBINATION LOCK

CROSS-REFERENCE TO RELATED APPLICATIONS

This application is a continuation-in-part of application Ser. No. 89,306, filed Aug. 25, 1987, now abandoned, which, in turn, is a continuation of Ser. No. 866,373, filed May 23, 1986, now abandoned.

BACKGROUND OF THE INVENTION

1. Field of the Invention

The present invention generally relates to a top-change combination lock including a hasp movable between unlatched and latched positions relative to a latch and, more particularly, to enabling the opening combination of such lock to be changed only when the hasp is in the unlatched position.

2. Description of the Prior Art

Combination locks are conventionally employed on luggage cases, such as suitcases or attache cases, to hold the lid or cover locked closed until a set of combination dials are turned to a user-settable opening combination. Such locks conventionally include a hasp assembly mounted on the lid, and having a spring-biased hasp pivotable between unlatched and latched positions, as well as a lock assembly mounted on the main container of the case, and having a latch movable into and out of latching engagement with the hasp by a user-operated actuator button outwardly accessible to a user. The lock assembly includes a set of rotatable combination dials, each bearing numerical indicia and, when set to a predetermined opening combination, permit the button to be moved to a release or open position in which the latch is disengaged from the hasp, thereby releasing the hasp from its latched position and permitting the hasp to return under the restoring action of an internal hasp spring to its unlatched position. Such locks may be of the deadbolt type in which the latch does not move relative to the button but, instead, jointly moves with the button, or of the livebolt type in which the latch is movable relative to the button.

The opening combination is pre-set by the lock manufacturer, but the user has been given the option of changing the opening combination to any desired sequence of indicia, presumably to some easily remembered code. In one prior art approach, the lock assembly includes a control element which extends through a wall of the case and into the interior thereof. By manipulating the interior control element in this so-called "bottom-change" lock, the user can set the opening combination to any desired sequence by turning the combination dials.

Although generally satisfactory for its intended purpose, the bottom-change lock has not proven to be altogether satisfactory because of the expensive and time-consuming assembly procedure involved in mounting the lock assembly on the case. Also, it is awkward to change the lock combination from the interior of the case. In addition, it is unattractive to have control elements extending into the interior of the case.

In order to avoid such drawbacks, the prior art has also proposed so-called "top-change" locks wherein the user can set the code from outside the case. In one prior art approach, the actuator button itself is used as the control element to permit the opening combination to be changed. For this purpose, since the actuator button is typically moved in one axial direction away from the combination dials to disengage the latch from the hasp, now, for the purpose of changing the opening combination, the actuator button is moved in the opposite axial direction toward the combination dials. The dual uses of the actuator button, when pushed in opposite axial directions, makes for a very versatile lock whose opening combination is convenient to alter, and which is attractive in appearance.

However, drawbacks have arisen When the actuator button itself is used for changing the opening combination. One problem concerns itself with the non-return of the button. Thus, the actuator button is normally maintained in a central position under the influence of a return spring within the lock assembly. When the hasp is in the latched position, the central position of the button defines a closed or locked position. When the button is pushed to the left away from the combination dials to the aforementioned release position, the latch is moved to the left and the hasp is unlatched. When the actuator button is released by the user, the button returns to the central position under the influence of the return spring.

Now, if the opening combination is to be changed, the user pushes the button to the right toward the dials to a combination-changing position. In the case of a deadbolt lock, the latch is also moved jointly to the right. While holding the button in the combination-changing position, the dials are turned as desired to the new opening combination. Once the button is released from the combination-changing position, it is returned by the return spring to the central position.

The problem has arisen in the prior art that the actuator button, in some cases, does not readily return from the combination-changing position to the central position. Although the return spring is supposed to automatically return the button to the central position, this does not always occur. Sometimes, when the hasp is in the closed position, the latch, which is jointly moved to the right when the button is moved to the combination-changing position, jams up against the hasp due to mechanical interference therewith. The restoring force of the return spring is sometimes insufficient to overcome this mechanical interference, with the result that the button becomes "stuck" in the combination-changing position. This sticking problem is particularly aggravated when the hasp is not properly aligned with the corresponding hasp opening in the lock assembly, which situation often occurs due to poor assembly procedures, or when the hasp assembly is placed on a lid wall which is either not flush, or is in some way misaligned, with the adjacent case wall on which the lock assembly is mounted. The lid wall and/or the adjacent case wall may have a rounded curvature which further worsens hasp alignment. The button-sticking problem could perhaps be overcome by providing the return spring with a higher spring characteristic, but this would only increase the force necessary to push the actuator to the release position and, hence, this is an undesirable solution.

Thus, experience has shown that the actuator button could either be deliberately or inadvertently moved to the combination-changing position, and the user could be unaware that the actuator button did not automatically return to the central position, in which event, further turning of the dials, either deliberately or inadvertently, would change the opening combination, perhaps to a sequence which is unknown to the user. Should this series of events occur when the hasp is in the latched position, the case would be locked and could not be opened because the user would be unaware of the opening combination.

In an attempt to provide at least a limited measure of relief against such a chain of circumstances, one prior top-change lock approach utilizes a livebolt design so that the lock can be picked by gaining access to the latch and pushing the latch out of latching engagement with the hasp. In another livebolt design according to the prior art, the actuator button itself is locked in the combination-changing position, and the user is compelled to affirmatively push the button back to the central position—a situation which is not always practiced, easily forgotten and usually ignored, and generally so inconvenient a procedure that the user often is reluctant to change the opening combination.

In the prior art top-change combination locks of the deadbolt type, since the lock cannot be picked by sliding the latch out of latching engagement with the hasp, the art has proposed a discrete control actuator which is separate from the actuator button. Thus, in this deadbolt design which, of course, is a more secure lock because of the inability to pick a deadbolt lock, two actuators must be operated in a certain sequence to change the opening combination. Experience has shown that it is awkward and complicated to perform this combination-changing procedure, with the result that the typical user prefers to keep the original opening combination rather than go to the trouble of changing the opening combination.

In addition, broken fingernails are unhappy by-products of the latter-described lock. Also, the use of two actuators renders the lock unattractive in appearance and expensive in construction.

SUMMARY OF THE INVENTION

1. Objects of the Invention

It is a general object of this invention to overcome the aforementioned drawbacks of the prior art combination locks of the type used on luggage cases.

It is another object of this invention to change the opening combination of a top-change combination lock of the deadbolt type only when the hasp is in the unlatched position.

It is a further object of this invention to employ the conventional actuator button used for releasing the hasp for the additional purpose of changing the opening combination without experiencing the above-described sticking or jamming problem.

Still another object of this invention is to prevent the opening combination from being changed either deliberately or inadvertently, by preventing the actuator button from being moved to the combination-changing position when the hasp is in the latched position.

Yet another object of this invention is to prevent one from being locked out of his or her luggage case on which such locks are employed.

A still further object of this invention is to provide a reliable, tamper-resistant, top-change combination lock of the deadbolt type which is simple in construction, inexpensive to manufacture, long-lasting in use, and durable.

2. Features of the Invention

In keeping with these objects, and others which will become apparent hereinafter, one feature of this invention resides, briefly stated, in a top-change combination lock of the deadbolt type, particularly for use on a luggage case, to hold a lid of the case locked closed with the aid of two such combination locks. Each combination lock includes a hasp assembly having a hasp movable between unlatched and latched positions, and a lock assembly. The lock assembly includes a shaft extending along an axis, and a plurality of user-settable combination dials mounted for rotation about, and sequentially arranged along, the shaft. The dials bear indicia which define an opening combination when the indicia are arranged in a predetermined opening sequence selected by a user.

The lock assembly also includes a latch axially movable into and out of latching engagement with the hasp. The lock assembly further includes a user-operated actuator, e.g. a button, operatively connected to the latch for joint movement therewith. The button is movable in one axial direction, e.g. toward the left, between a closed position in which the latch lockingly engages the hasp when the hasp is in the latched position, and an open position in which the latch is disengaged from the hasp to enable the hasp to be moved to the unlatched position when the opening combination has been set. The button is also movable in an opposite axial direction, e.g. toward the right, countercurrent to said one axial direction to a combination-changing position in which the opening combination is changeable.

In accordance with this invention, the above-described top-change combination lock has been improved by permitting the opening combination to be changed only when the hasp is in the unlatched position. In other words, it is not possible for one to be locked out of his or her luggage case by being unaware of the opening combination, since the opening combination can only be changed when the case is open. For this purpose, this invention proposes means for preventing the actuator from being axially moved along said opposite axial direction from the closed position to the combination-changing changing position when the hasp is in the latched position. This preventing means includes a stop on the latch. The stop is positioned to abut against the hasp, when the hasp is in the latched position in the event that axial movement of the actuator along said opposite axial direction is attempted. Thus, the aforementioned jamming or sticking problem is reliably prevented because the actuator and the latch cannot be moved to the combination-changing position unless the hasp is in its unlatched position. The latch can no longer mechanically interfere with the hasp because, simply put, the hasp is not located in the hasp hole of the lock assembly.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 1 is a front view of a top-change combination lock of the deadbolt type mounted on a luggage case shown in broken-away view in accordance with this invention;

FIG. 2 is a sectional view taken along line 2—2 of FIG. 1;

FIG. 3 is a rear sectional view taken along line 3—3 of FIG. 2 on a slightly reduced scale;

FIG. 4 is a sectional view shown in a greatly enlarged scale taken on line 4—4 of FIG. 3;

FIG. 5 is a partially broken-away perspective view of a stop in accordance with this invention as provided on the latch of the lock of FIG. 1;

DETAILED DESCRIPTION OF THE PREFERRED EMBODIMENTS

Figure 6:
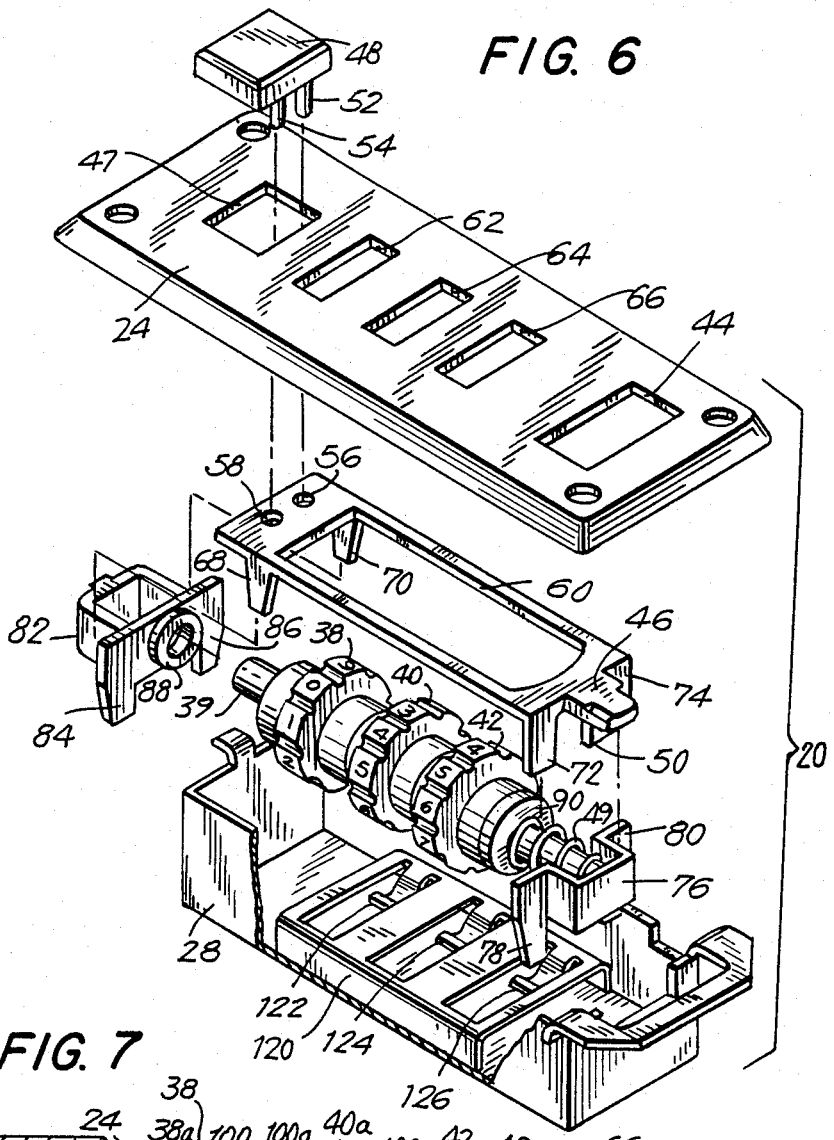
FIG. 6 is an enlarged exploded perspective view of the lock of FIG. 1.

Referring now to the drawings, as shown in FIG. 1, a top-change combination lock 10 of the deadbolt type is shown mounted on a luggage case 12, the latter being shown in broken-away view. The case 12 is conventional, and has a lid 14 that is hinged to a main container 16. As shown in FIG. 1, the lid 14 is locked closed upon the container 16.

A pair of combination locks are conventionally provided on the case, each lock being disposed on opposite sides of a non-illustrated carrying handle. The invention will now be described in detail with respect to a representative one of the locks, it being appreciated that the description suffices for the other lock.

The lock 10 includes a hasp assembly 18 mounted on the lid 14, and a lock assembly 20 mounted on the container 16. The hasp assembly 18 has a conventional spring-biased hasp 22 which is pivotable between an unlatched or open position and a latched or closed position (see FIG. 1). In the latched position, the lid 14 is locked closed, and may be opened only when the lock assembly 20 is set to an opening combination as described below, and actuated so that the hasp spring releases the hasp.

The lock assembly 20 is essentially conventional, and is described in detail below in connection with FIGS. 6 and 7. At this stage of the discussion, it is believed to be sufficient to point out that the lock assembly 20 includes a generally rectangular face plate 24 provided with four corner openings through which rivets 26 or analogous fasteners extend for attaching the lock assembly 20 to the container 16. By the same token, the hasp assembly 18 includes a mounting plate 32 mounted on a top wall 34 of the lid 14 with the aid of rivets 36 or analogous fasteners.

As shown in FIG. 3, a lock housing 28 is secured to the rear side of the face plate 24, and is inserted into a corresponding cavity formed in a top wall 30 of the container 16.

Face plate 24 has a plurality of slots through which combination dials 38, 40, 42 protrude and are manually accessible, respectively. Each has a series of combination indicia, e.g. numerals 0 through 9, spaced about its periphery and capable of being exposed in a respective slot. The dials are mounted for rotation on, and are axially sequentially arranged along, a shaft 39 mounted in the housing 28. The indicia exposed through the face plate define a combination or code, and one of the codes which may be set in advance by the lock manufacturer and/or the user represents an opening combination.

The hasp opening 44 (see FIG. 4) in the face plate 24 receives the hasp 22 for engagement with a spring-biased latch or bolt 46. The leading end of the bolt 46 may be tapered to facilitate the latching engagement between the latch 46 and the hasp 22. A manual actuator or button 48 is operatively connected to the bolt 46 for joint movement therewith. The button 48 is, as shown in FIG. 1, in its rest or central position in which the bolt 46 lockingly engages the hasp 22 when said hasp is in its latched position, thereby defining a locked condition for the lock (see enlarged view of FIG. 4).

The button 48 is mounted in an axially elongated slot 47 formed in the face plate 24, and may be slid axially linearly along the slot. For example, the button 48 may be moved by the user toward the left in FIG. 1 to an open or release position in which the bolt 46 is likewise moved to the left and in which the bolt 46 is disengaged from the hasp 22, thereby releasing the hasp and permitting the hasp spring to automatically return the hasp to the unlatched position. This joint movement of the button 48 and the bolt 46 is only permitted when the opening combination is set in advance and exposed through the face plate 24.

The button 48 may also be slid axially linearly toward the right in FIG. 1 to a combination-changing position in which the opening combination can be changed merely by the expedient of holding the button 48 in the combination-changing position, and simultaneously turning the dials to another sequence of indicia. Once the new opening combination has been set, the button 48 may be released by the user, in which event, an internal spring 49 within the lock housing 28 is normally operative to automatically return the button 48 to the illustrated center position.

As described previously, experience has shown that the internal spring 49 which returns the button 48 from either the release position or the combination-changing position to the central position does not always work as intended to return the button 48 to the central position. Sometimes, the button "sticks" in the combination-changing position and does not, or only partially, return to the central position. Should the dials 38, 40, 42 be turned under such circumstances, either deliberately by a tamperer or inadvertently by the authorized user, then the opening combination will be changed without the knowledge of the authorized user. The case is then locked and cannot be opened. Since the lock 10 is of the deadbolt type, it cannot be picked as with a livebolt design, because the bolt 46 cannot be moved relative to the button 48. The sticking problem is aggravated when the hasp 22 is not properly aligned with the hasp opening 44, so that the bolt 46 does not freely travel into and out of the hasp. If there is misalignment between the bolt 46 and the hasp 22, for whatever reason, e.g. the top wall 34 and/or the top wall 30 are rounded, or are not flush with each other, or the hasp and lock assemblies were poorly mounted on their respective top walls, then the bolt 46 could mechanically interfere with and jam up against the hasp 22 when the button 48 is moved to the combination-changing position, thereby preventing a free return of the bolt 46.

Hence, in accordance with this invention, means are provided for preventing the button 48 from being axially moved from the central position to the combination-changing position when the hasp 22 is in the latched position. The preventing means advantageously is constituted by a stop 50 on the bolt 46, and preferably integral therewith. The stop 50 is positioned on the leading end of the bolt 46 so as to abut against the hasp 22 when the hasp is in the latched position in the event that axial movement of the button toward the combination-changing position is attempted.

Hence, the opening combination is changeable only when the hasp is in the unlatched position. It is no longer possible for the authorized user to inadvertently, or, for that matter, a tamperer or other mischievous individual, to deliberately change the combination when the hasp is in the latched position. The user can no longer be locked out of his or her case.

As best shown in FIG. 5, the stop 50 extends partially across the width of the leading end of the bolt 46. Of course, the stop 50, in an alternative embodiment, may extend over the full width of the leading end of the latch 46. The stop 50 need not be made of a single projection, but may comprise a plurality of projections so long as at least one of the projections would be in the path of travel of the bolt 46 toward the combination-changing position. The stop 50 may have ribs or gussets for reinforcement to the bolt 46 so as to withstand the anticipated shearing forces in the event that axial movement of the latch 46 toward the combination-changing position is attempted when the hasp is in the latched position. The stop 50 is advantageously molded in a one-piece construction with the latch 46 and, for that purpose, may be made of any moldable metal, plastic or analogous hard material.

Figure 7:
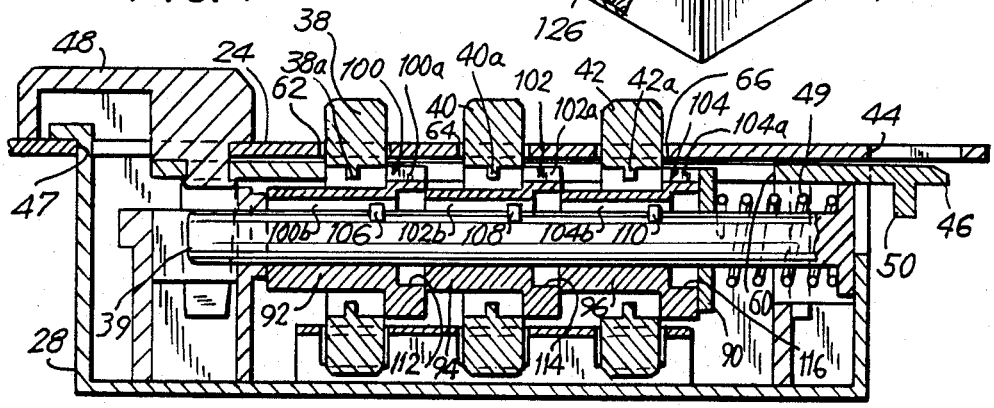
FIG. 7 is an enlarged sectional view of the assembled lock of FIG. 1.

Turning now to FIGS. 6 and 7, the button 48 has two downwardly extending stakes 52, 54 which are inserted into corresponding holes 56, 58 of the bolt 46. The free ends of the stakes are peened over so that the button and the bolt move jointly either to the open condition at the left side of the slot 47 or to the combination-changing condition at the right side of the slot 47 (see FIG. 7).

The bolt 46 has a generally rectangular frame with a large central opening 60 so that dials 38, 40, 42 may extend through the same into their respective openings 62, 64, 66 in the face plate 24. A rear set of downwardly extending legs 68, 70 and a front set of downwardly extending legs 72, 74 extend toward the base of the casing 28.

A front support member 76 having outer, planar wings 78, 80 is seated within a front end region of the casing 28. A rear support member 82 having outer, planar wings 84, 86 is seated within a rear end region of the casing 28. The rear support member 82 has a central aperture 88 in which a rear end of the aforementioned shaft 39 is journaled. The front end of the shaft 39 is integral with the front support member 76. The aforementioned spring 49 surrounds the front end of the shaft 39, and has one end bearing against the front support member 76, and an opposite end bearing against a washer 90 positioned axially adjacent a sleeve 96.

Each dial 38, 40, 42 is respectively associated with coaxially arranged sleeves 92, 94, 96. Each dial is formed, in conventional manner, with ten pins extending radially inwardly of an inner circumferential surface thereof, each pin, e.g. see representative pins **38*a*, 40*a*, 42*a*, corresponding to one of the ten indicia provided on an outer circumferential surface of the respective dial. Each sleeve 92, 94, 96 is provided with a cylindrical flange 100, 102, 104 having an axially-extending outer slot, e.g. see representative slots 100*a*, 102*a*, 104*a*, dimensioned to receive a selected one of the pins which, in turn, corresponds to a selected indicia. The sleeves 92, 94, 96 also have an axially-extending inner channel, e.g. see representative channels 100*b*, 102*b*, 104*b*, dimensioned to receive keys 106, 108, 110 arranged axially along the shaft 39**.

In the assembled condition of the lock, the rear legs 68, 70 abut against the rear surfaces of wings 84, 86; and the front legs 72, 74 abut against the front surfaces of wings 78, 80. Thus, when one moves button 48 to the right to the position shown in FIG. 7, the rear legs 68, 70 push the sleeves 92, 94, 96, all of which are in abutting engagement, toward the front of the lock assembly, thereby compressing the spring 49. The shaft 39 does not move. The inner channels **100*b*, 102*b*, 104*b* of the sleeves slide axially along the keys 106, 108, 110 of the stationary shaft. The outer channels 100*a*, 102*a*, 104*a* of the sleeves slide axially out of engagement with the pins 38*a*, 40*a*, 42*a***, thereby freeing the dials to be turned in order to set another opening combination for the lock assembly.

Upon release of the button 48, the spring 49 returns the sleeves, the rear legs 68, 70, the bolt 46 and the button 48 to the aforementioned central position centrally located in slot 47. The inner channels **100*b*, 102*b*, 104*b* slide axially along the keys 106, 108, 110 in the opposite direction. The outer channels 100*a*, 102*a*, 104*a* slide axially and engage the respective pin of a respective dial which has been axially aligned with each of the outer channels during the previous re-setting of the opening combination. In the central position, the dials can be turned, and simultaneously the sleeves will turn about the shaft 39, because the keys 106, 108, 110 are no longer located within the inner channels 100*b*, 102*b*, 104*b*, but are now situated with clearance in end bores 112, 114, 116** of the sleeves. Hence, the dials can be moved so that the opening combination does not appear above the face plate.

In order to open the lock assembly, the dials have to be set to the opening combination, and the button 48 thereupon moved to the left or rear of the casing 28, in which case, the front legs 72, 74 push the wings 78, 80 toward the rear of the lock assembly, thereby compressing the spring 49. The shaft 39 axially moves toward the rear of the casing. The sleeves do not move from the central position described above. The bolt 46, of course, moves to the left, thereby becoming disengaged from the hasp 22 located within the hasp opening 44. Upon release of the button 48, the spring 49 returns the bolt to the central position.

A spring finger plate 120 having springy fingers 122, 124, 126 is situated in the casing 28 below the dials, each finger resiliently engaging a selected notch formed on the outer periphery of a respective dial to retain the dial, at least temporarily, at a desired setting.

It will be understood that each of the elements described above, or two or more together, also may find a useful application in other types of constructions differing from the types described above.

While the invention has been illustrated and described as embodied in a top-change combination lock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a top-change combination lock of the deadbolt type including (A) a hasp assembly having a hasp movable between unlatched and latched positions, and (B) a lock assembly having an opening combination settable by a user, including (i) a latch axially movable into and out of latching engagement with the hasp, and (ii) a user-operated actuator operatively connected to the latch for joint movement therewith, (a) said actuator being movable in one axial direction between a closed position in which the latch lockingly engages the hasp when the hasp is in the latched position, and an open position in which the latch is disengaged from the hasp to enable the hasp to be moved to the unlatched position when the opening combination has been set, (b) said actuator being movable in an opposite axial direction countercurrent to said one axial direction to a combination-changing position in which the opening combination is changeable, the improvement comprising:

means for preventing the actuator from being axially moved along said opposite axial direction from the closed position to the combination-changing position when the hasp is in the latched position, said preventing means including a stop integral with the latch for abutting against the hasp when the hasp is in the latched position in the event that axial movement of the actuator along said opposite axial direction is attempted, whereby the opening combination is changeable only when the hasp is in the unlatched position.

2. For use on a luggage case to hold a lid of the case locked closed with the aid of two top-change combination locks of the deadbolt type, each lock comprising:

(A) a hasp assembly having a hasp movable between unlatched and latched positions, (B) a lock assembly having an opening combination settable by a user including (i) a latch axially movable into and out of latching engagement with the hasp, and (ii) a user-operated actuator operatively connected to the latch for joint movement therewith, (a) said actuator being movable in one axial direction between a closed position in which the latch lockingly engages the hasp when the hasp is in the latched position, and an open position in which the latch is disengaged from the hasp to enable the hasp to be moved to the unlatched position when the opening combination has been set, (b) said actuator being movable in an opposite axial direction countercurrent to said one axial direction to a combination-changing position in which the opening combination is changeable, and (C) means for preventing the actuator from being axially moved along said opposite axial direction from the closed position to the combination-changing position when the hasp is in the latched position, said preventing means including a stop integral with the latch for abutting against the hasp when the hasp is in the latched position in the event that axial movement of the actuator along said opposite axial direction is attempted, whereby the opening combination is changeable only when the hasp is in the unlatched position.

* * * * *